US006350171B1

(12) United States Patent
Hippely et al.

(10) Patent No.: US 6,350,171 B1
(45) Date of Patent: Feb. 26, 2002

(54) TOY MOTORCYCLE CONFIGURABLE AS A HOVERCYCLE

(75) Inventors: Keith A. Hippely, Manhattan Beach; Alessandro Ioviero, El Monte, both of CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/497,446

(22) Filed: Feb. 3, 2000

(51) Int. Cl.[7] ..... A63H 17/16
(52) U.S. Cl. ..... 446/440; 446/487
(58) Field of Search ..... 446/431, 440, 446/471, 487, 465, 451

(56) References Cited

U.S. PATENT DOCUMENTS

| | | | | |
|---|---|---|---|---|
| D276,059 | S | | 10/1984 | Smollar et al. |
| D276,060 | S | | 10/1984 | Smollar et al. |
| D276,251 | S | | 11/1984 | Wakimura |
| 4,516,948 | A | | 5/1985 | Obara |
| 4,529,391 | A | | 7/1985 | Hoshino et al. |
| D280,750 | S | | 9/1985 | Toshimasa |
| D280,751 | S | | 9/1985 | Toshimasa |
| D281,001 | S | | 10/1985 | Ohno |
| D281,087 | S | | 10/1985 | Ohno |
| D281,088 | S | | 10/1985 | Murakami |
| D281,795 | S | | 12/1985 | Shimomura |
| D281,796 | S | | 12/1985 | Shimomura |
| 4,571,203 | A | | 2/1986 | Murakami |
| 4,578,046 | A | | 3/1986 | Ohno |
| 4,580,993 | A | | 4/1986 | Ohno |
| 4,586,911 | A | * | 5/1986 | Murakami ..... 446/376 |
| 4,599,078 | A | * | 7/1986 | Obara ..... 446/95 |
| D285,466 | S | | 9/1986 | Ohno |
| D286,800 | S | | 11/1986 | Maruyama |
| 4,674,990 | A | * | 6/1987 | Ohno ..... 446/376 |
| D296,801 | S | | 7/1988 | Matsumoto |
| D301,359 | S | | 5/1989 | Shinohara |
| D303,412 | S | | 9/1989 | Matsuda |
| D340,757 | S | | 10/1993 | Chen |

* cited by examiner

*Primary Examiner*—Jacob K. Ackun, Jr.
*Assistant Examiner*—Faye Francis
(74) *Attorney, Agent, or Firm*—Roy A Ekstrand

(57) ABSTRACT

A toy motorcycle body supports a pair of front-to-back extending chassis shafts in a pivotal attachment. A front wheel and a rear wheel are each formed of respective wheel halves and supported by the pivotable chassis shafts. The chassis shafts each support respective lever cams which cooperate with a pivotally supported lever actuated by the user. The chassis shafts also support a pair of spring cams which cooperate with a return spring. The action of the spring upon the spring cams pivots the chassis shafts to place the front and rear wheel halves together configuring the toy motorcycle as a conventional motorcycle. The manipulation of the pivotally supported lever by the user overcomes the spring force and pivots the chassis shafts so as to move the respective wheel halves to a split outwardly extending configuration to mimic a hovering device.

8 Claims, 3 Drawing Sheets

TOY MOTORCYCLE CONFIGURABLE AS A HOVERCYCLE

FIELD OF THE INVENTION

This invention relates generally to toys and toy figures and particularly to those which are capable of being configured in alternate configurations and appearances.

BACKGROUND OF THE INVENTION

Toys which are configurable between alternate appearances and configurations are well known in the art. Such toys are characterized by a first configuration such as a toy vehicle or the like. Typically, such toys are formed of a plurality of articulated elements movable in various combinations and directions to assume a first configuration and appearance. Such toys are further characterized by the ability to move the plurality of articulated elements to form a second configuration usually exhibiting a different appearance such as a robot or the like. One of the important characteristics of such configurable toys is the use of elements which are capable of moving to assume an alternate shape of the toy. In most such configurable toys, the elements are formed of molded plastic and usually exhibit a highly stylized appearance. For maximum play value and amusement, the configurations are generally chosen to exhibit a substantially different type of toy. For example, U.S. Pat. No. 4,571,203 issued to Murakami sets forth a FORM-CONVERTIBLE TOY ROBOT which includes a plurality of body parts such as head, arms, shoulders, thighs and legs to form a robot which are variously articulated to reconfigure the toy into a toy motorcycle.

U.S. Pat. No. 4,529,391 issued to Hoshino et al. sets forth a TOY HAVING TWO MODES OF LOCOMOTION in which a rotatable fly wheel motor is positioned within a toy motorcycle. The toy motorcycle is formed of a plurality of movable elements which may be moved to alternate configurations and thereby form a fanciful creature. The second mode of appearance is also characterized by an alternative mode of propulsion using the appendages.

U.S. Pat. Des. No. 281,087 and U.S. Pat. Des. No. 281,001 both issued to Ohno and both entitled RECONFIGURABLE TOY VEHICLE set forth similar designs for a toy vehicle which is alternately configurable as a robot.

U.S. Pat. Des. No. 281,088 issued to Murakami sets forth a TOY ROBOT CONVERTIBLE INTO AUTOBIKE which is substantially identical to the above referenced U.S. Pat. No. 4,571,203.

U.S. Pat. Des. No. 285,466 issued to Ohno sets forth a RECONFIGURABLE TOY VEHICLE having a first appearance and configuration simulating a military toy vehicle commonly known as a "jeep" and an alternate configuration resembling a fanciful robot.

U.S. Pat. Des. No. 286,800 issued to Maruyama sets forth a RECONFIGURABLE TOY HAWK having a spherical toy formed of a plurality of articulated members which reconfigure to a fanciful depiction of a hawk-like creature.

U.S. Pat. Des. No. 296,801 issued to Matsumoto and entitled RECONFIGURABLE TOY AUTO BIKE and U.S. Pat. Des. No. 301,359 issued to Shinohara entitled RECONFIGURABLE TOY BIKE sets forth toy motorcycles which are reconfigurable into fanciful robot-like creatures. U.S. Pat. Des. No. 303,412 issued to Matsuda sets forth a RECONFIGURABLE TOY JEEP/HELICOPTER having a first configuration resembling a helicopter like vehicle and a second configuration resembling a military vehicle known as a jeep.

U.S. Pat. No. 4,580,993 issued to Ohno sets forth a RECONFIGURABLE TOY ASSEMBLY having alternate configurations resembling a robot and a pick-up truck like toy vehicle.

U.S. Pat. No. 4,516,948 issued to Obara sets forth a RECONFIGURABLE TOY ASSEMBLY capable of forming a tractor-trailer toy vehicle and a robot.

U.S. Pat. No. 4,578,046 issued to Ohno sets forth a REVERSIBLE TRANSFORMABLE TOY BLOCK ASSEMBLY sets forth a toy vehicle formed of multiply articulated components which are reconfigurable to form a robot.

Several design patents show various different appearance designs for toy motorcycles. For example, U.S. Pat. Des. No. 276,251 issued to Wykimura and U.S. Pat. Des. No. 340,757 issued to Chen each entitled TOY MOTORCYCLE shown different appearances for toy motorcycles.

Additional toy motorcycle designs are shown in U.S. Pat. Des. No. 281,795 issued to Shimomura and U.S. Pat. Des. No. 280,750 issued to Toshimasa and U.S. Pat. Des. No. 281,796 issued to Shimomura and U.S. Pat. Des. No. 280,751 issued to Toshimasa all of which are entitled TOY MOTORCYCLE.

U.S. Pat. Des. No. 276,059 and U.S. Pat. Des. No. 276,060 both issued to Smollar et al. and both entitled TOY MOTORCYCLE show similar appearance toy motorcycles.

While the foregoing described prior art device have to some extent improved the art and in some instances enjoyed commercial success, there remains nonetheless a continuing need in art for evermore amusing, entertaining and improved toy motorcycles configurable in alternate toy shapes and configurations.

SUMMARY OF THE INVENTION

Accordingly, it is a general object of the present invention to provide an improved toy motorcycle. It is a more particular object of the present invention to provide an improved toy motorcycle which is configurable into an alternate toy. It is a still more particular object of the present invention to provide an improved toy motorcycle which is alternately configurable as a hovercycle.

In accordance with the present invention there is provided a toy motorcycle configurable between a motorcycle configuration and a hovercycle configuration, the toy motorcycle comprising: a body having a chassis box therein; a pair of chassis shafts pivotally supported by the chassis box each shaft having a front end and a rear end; a pair of front fork halves each supported by the front ends of the chassis shafts; a pair of front wheel halves each supported by the front fork halves; a pair of rear fork halves each supported by the rear ends of the chassis shafts; a pair of rear wheel halves each supported by the rear fork halves; and means for pivoting the chassis shafts between a first position, in which the front and rear fork halves and the front and rear wheel halves are in contact defining the motorcycle configuration, and a second position in which the front and rear fork halves and the front and rear wheel halves extend outwardly defining the hovercycle configuration.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
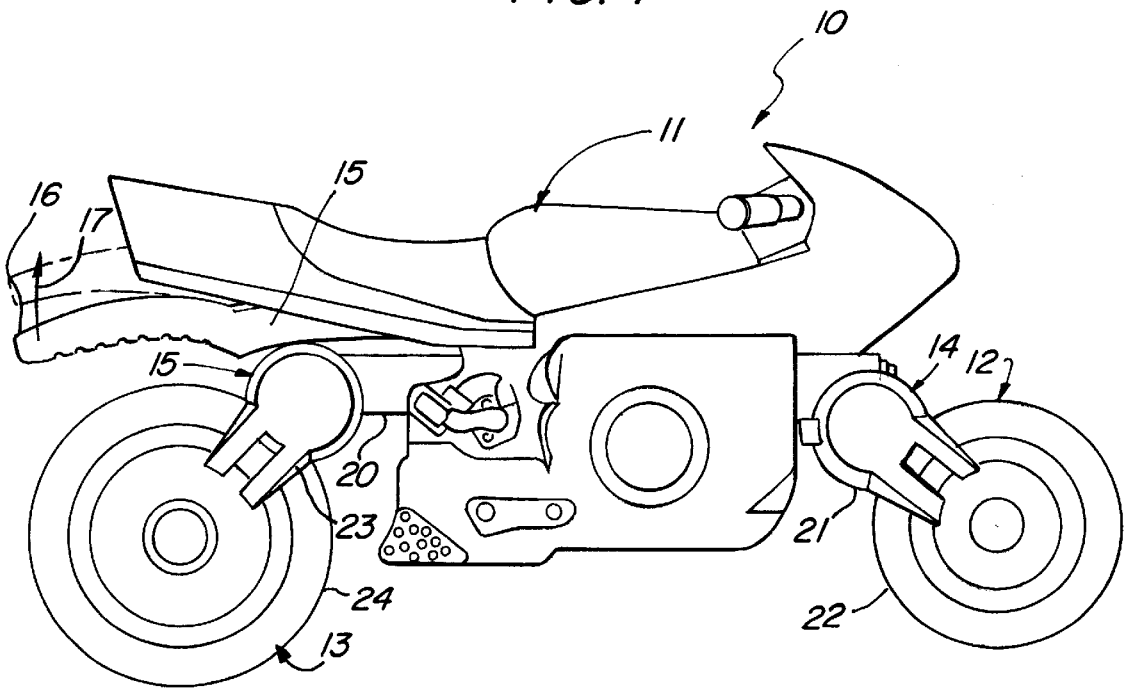
FIG. 1 sets forth a side elevation view of the present invention toy motorcycle in its motorcycle configuration.

FIG. 1 sets forth a side elevation view of a toy motorcycle constructed in accordance with the present invention and generally referenced by numeral 10. Motorcycle 10 includes a body 11 preferably formed of a molded plastic material or the like. Motorcycle 10 further includes a chassis shaft 20 having an elongated cylindrical shape extending through body 11. Motorcycle 10 further includes a front fork 14 and a front wheel 12 supported by chassis shaft 20 together with a rear wheel 13 and a rear fork 15 also supported by shaft 20. As is better seen in FIG. 2 below, front wheel 12 is formed of wheel halves 22 and 32 while rear wheel 13 is similarly formed of wheel halves 24 and 34. In addition, front fork 14 and rear fork 15 are formed of fork halves 21 and 31 and 23 and 33 respectfully (also seen in FIG. 2). A lever 15 is pivotally supported by body 11 in the manner set forth below in greater detail. Lever 15 includes and outer end 16 which is movable with respect to body 11 upwardly in the direction indicated by arrow 17 to the dash-line position indicated in FIG. 1.

In accordance with the present invention, motorcycle 10 when configured in its motorcycle configuration shown in FIG. 1 is capable of conventional toy motorcycle play by the child user. Thus, motorcycle 10 may be rolled about on front wheel 12 and rear wheel 13 as the child user plays with the toy motorcycle. In accordance with a further advantage of the present invention, end 16 of lever 15 may be pivoted upwardly in the direction indicated by arrow 17 to transform motorcycle 10 to its hovercycle configuration shown in FIG. 2. As the child user releases end 16 of lever 15, motorcycle returns to the conventional motorcycle configuration of FIG. 1.

Figure 2:
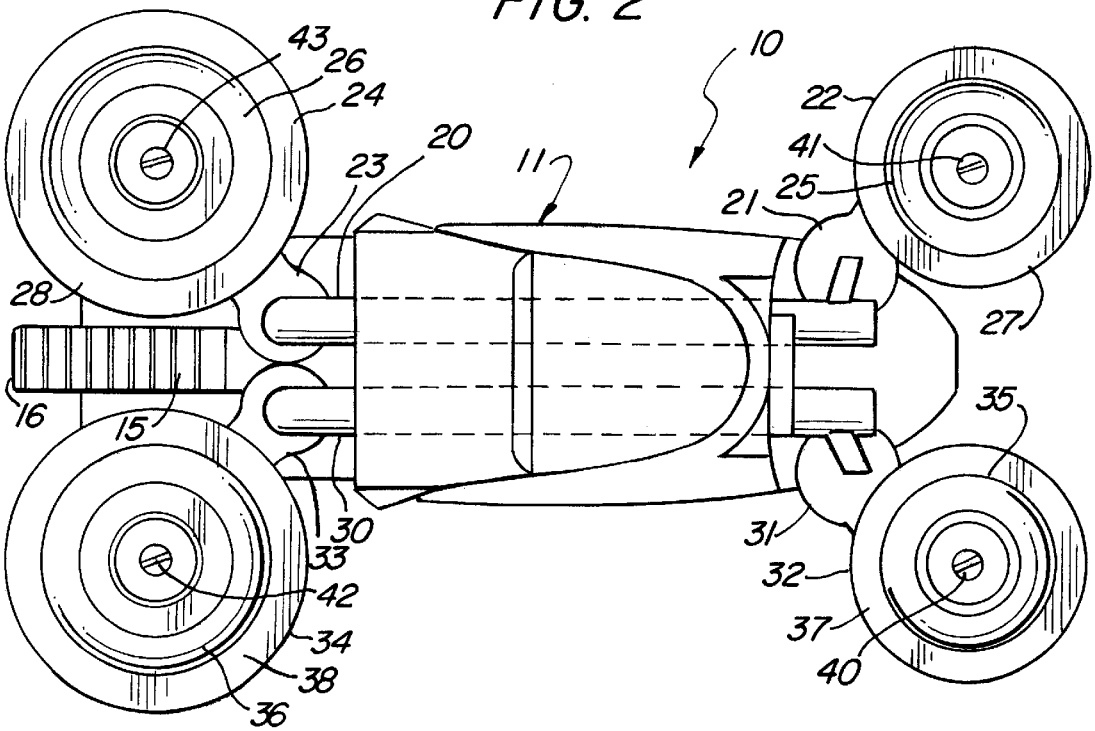
FIG. 2 sets forth a bottom plan view of the present invention toy motorcycle configured in its alternate hovercycle configuration.

FIG. 2 sets forth a bottom view of toy motorcycle 10 configured in is alternate configuration in which motorcycle 10 forms a hovercycle. A hovercycle is a fanciful device in which a plurality of downwardly directed power driven fans or propellers produce sufficient downward force to levitate the vehicle. While toy motorcycle 10 is not operational in this manner, the alternate configuration of the present invention toy motorcycle shown in FIG. 2 does provide a fanciful depiction of this hovercycle.

More specifically, motor cycle 10 includes a body 11 supporting a pair of chassis shafts 20 and 30 which are rotatably supported by body 11 in the manner described below. Suffice it to note here, that chassis shaft 20 extends through body 11 in a front-to-back orientation and supports a pair of fork halves 21 and 23 at each end thereof. Fork half 21 supports a wheel half 22 which is rotatably secured to fork half 21 by a conventional fastener 41. Fastener 41 serves as a rotation axle in the manner best seen in FIG. 6. Wheel half 22 further defines an annular groove 25 and an annular surface 27. Similarly, fork half 23 rotatably supports a wheel half 24 using a fastener axle 43. Wheel half 24 defines an annular groove 26 and an annular surface 28.

In a similar fashion, chassis shaft 30 supports fork halves 31 and 33 at each end thereof. Fork half 31 supports a wheel half 32 using a fastener 40 as a rotation axle. Wheel half 32 further defines an annular rib 35 and an annular surface 37. Fork half 33 further supports a wheel half 34 in a rotatable attachment using fastener 42 as an axle and fastener. Wheel half 34 further defines a rib 36 and an annular surface 38.

Figure 3:
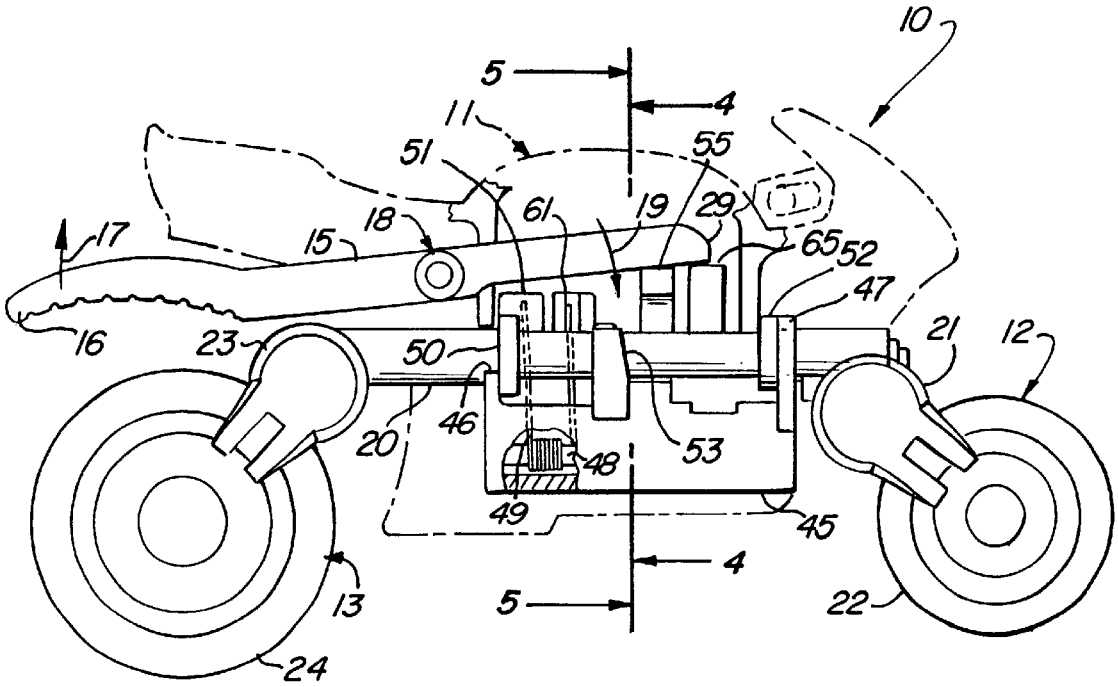
FIG. 3 sets forth a partial side elevation view of the internal support mechanism of the present invention toy motorcycle.

An elongated lever 15 having an end 16 is supported within body 11 in the manner shown in FIG. 3.

In the hovercycle configuration of motorcycle 10 shown in FIG. 2, the outward pivotal movements of chassis shafts 20 and 30 induced by movement of lever 15 in the manner set forth below in FIGS. 5 and 6 splits the respective wheel halves of front wheel 12 and rear wheel 13 into outwardly extending simulated hover producing devices replicated by wheel halves 22 and 32 in front and wheel halves 24 and 34 in the rear of motorcycle 10. Thus, in this configuration, body 11 appears to be supported by a quartet of downwardly directed hover producing apparatus for fanciful play by the child user.

To further enhance the standard motorcycle appearance of toy motorcycle 10, wheel half 22 defines an annular groove 25 while wheel half 32 defines an annular rib 35. When wheel halves 22 and 32 are joined at surfaces 27 and 37 to form front wheel 12 (seen in FIG. 1) rib 35 is received within groove 25 to further enhance this joining of wheel halves to form a standard appearing front wheel. Similarly, wheel half 24 defines an annular groove 26 while wheel half 34 defines an annular rib 36. Thus, wheel halves 24 and 34 join to form wheel 13 as rib 36 is received within groove 26 allowing surfaces 28 and 38 to be in flush contact.

FIG. 3 sets forth a partially sectioned side elevation view of motorcycle 10 configured in its motorcycle configuration in which body 11 is shown in dashed outline to allow illustration of the internal support mechanism of the toy motorcycle. Body 11 supports a chassis box 45 which in turn defines a front journal 47 and a rear journal 46. An elongated chassis shaft 20 is rotatably supported within journals 46 and 47 and defines a pair of flanges 50 and 52 to maintain the positioning of chassis shaft within chassis box 45. Chassis shaft 20 supports a fork half 21 which in turn supports a wheel half 22. Chassis shaft 20 also supports a fork half 23 which in turn supports a wheel half 24.

Figure 4:
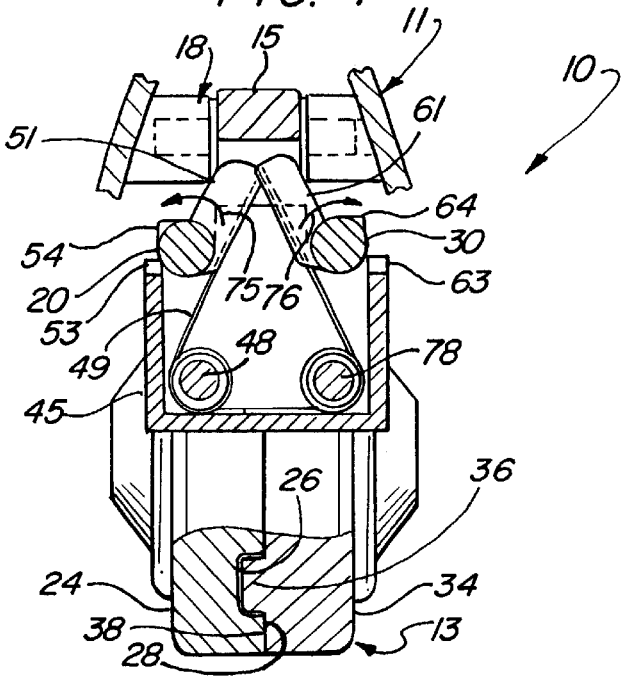
FIG. 4 sets forth a partial section view of the present invention motorcycle taken along section line 4—4 in FIG. 3.

A lever 15 having an end 16 and an end 29 is pivotally supported upon body 11 in the manner best seen in FIG. 4 by a pivot mechanism 18. Thus, the pivotal support of lever 15 allows end 16 to be moved upwardly in the direction indicated by arrow 17 causing a corresponding downward movement of end 29 in the direction indicated by arrow 19.

As is better seen in FIG. 2, body 11 supports a pair of chassis shafts 20 and 30 in a generally parallel arrangement. Chassis shaft 20 further defines a spring cam 51 and a lever cam 55. Chassis box 45 further defines an upwardly extending stop 53 while chassis shaft 20 defines a stop tab 54. Stop tab 54 and stop 53 cooperate to limit the pivotal movement of chassis shaft 20 within chassis box 45 in the inwardly pivoting movement to the position shown in FIG. 3.

Chassis box 45 further includes a shaft 48 which in turn supports a spring 49. Spring 49 engages spring cam 51 of shaft 20 producing a spring force which urges rotation of shaft 20 toward the inward position shown in FIGS. 1 and 3 corresponding to the standard motorcycle configuration of toy motorcycle 10. A second spring cam 61 is supported by shaft 30 (seen in FIG. 4). A second lever cam 65 is also supported by chassis shaft 30 (seen in FIG. 5). Of importance to note in FIG. 3, is the operation by which the upward movement of end 16 of lever 15 in the direction of arrow 17 forces end 29 of lever 15 downwardly in the direction of arrow 19 against lever cams 55 and 65. With temporary reference to FIGS. 5 and 6, it will be noted that this movement of lever 15 and the resulting outward rotations of chassis shafts 20 and 30 (seen in FIG. 5) forces the respective wheel halves of front wheel 12 and rear wheel 13 outwardly to the alternate configuration shown in FIGS. 2 and 6.

FIG. 4 sets forth a partial section view of toy motorcycle 10 taken along section lines 4—4 in FIG. 3. As described above, body 11 supports a chassis box 45 within which a shaft 48 is supported. Shaft 48 supports a portion of spring 19. A shaft 78 is also supported within chassis box 45 and further supports spring 49. A chassis shaft 20 is rotatably supported within chassis box 45 and includes a stop tab 54 and a spring cam 51. Similarly, a chassis 30 is rotatably supported within chassis box 45 and includes a stop tab 64 and a spring cam 61. The upwardly extending end portions of spring 49 exert a force against spring cams 51 and 61 which urge rotation of chassis shafts 20 and 30 in the directions indicated by arrows 75 and 76.

A rear wheel 13 is formed of a pair of wheel halves 24 and 34 supported by chassis shafts 20 and 30 respectively in the manner shown in FIG. 2. Wheel half 24 defines a groove 26 and a surface 28. Correspondingly, wheel half 34 defines a rib 36 received within groove 26 and a surface 38 received upon surface 28 of wheel half 24. In this manner, rear wheel 13 is formed of a pair of rotatable wheel halves 24 and 34.

Body 11 further includes a pivot mechanism 18 which pivotally supports a lever 15 in the manner set forth above in FIG. 3.

Thus, in the section view of FIG. 4, the cooperation between spring 49 and spring cams 51 and 61 is operative upon chassis shafts 20 and 30 to maintain toy motorcycle 10 in its standard configuration as illustrated in FIG. 1. It will be apparent that a residual spring force is provided by spring 49 tending to maintain the closure of wheel halves 34 and 24. While not shown in FIG. 4, it will be understood that the similar attachment of wheel halves 22 and 32 which form front wheel 12 are also maintained in their closed position by the action of spring 49 upon spring cams 51 and 61.

Figure 5:
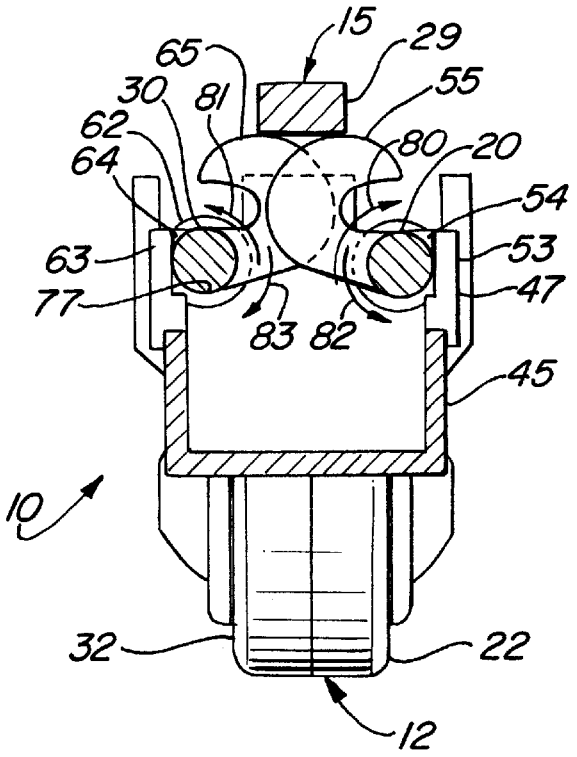
FIG. 5 sets forth a partial section view of the present invention toy motor cycle taken along section lines 5—5 in FIG. 3.

FIG. 5 sets forth a partial section view of toy motorcycle 10 taken along section lines 5—5 in FIG. 3. As described above, toy motorcycle 10 includes a chassis box 45 having supporting journals 47 and 77 formed therein. Chassis box 45 further defines a pair of upwardly extending stops 53 and 63. A chassis shaft 20 is rotatably supported within journal 47 of chassis box 45 and maintained in position by a flange 52. Chassis shaft 20 further includes a lever cam 55 having a curved outer surface and extending inwardly from chassis shaft 20. A chassis shaft 30 is rotatably supported within journal 47 and includes a flange 62 maintaining the position of chassis shaft 30 within chassis box 45. Chassis shaft 30 further includes an inwardly extending lever cam 65 having a curved outer surface and a flange 62 maintaining the position of chassis shaft 30. Chassis shafts 20 and 30 define respective stop tabs 54 and 64. Tabs 54 and 64 cooperate with stops 53 and 63 respectively to limit the pivoting movement of chassis shafts 20 and 30 in the directions indicated by arrows 80 and 81.

Front wheel 12 is formed of a pair of wheel halves 22 and 32 supported upon chassis shafts 20 and 30 respectively in the manner shown in FIG. 2. As described above, the pivotal position of shafts 20 and 30 is urged toward the closed configuration of FIG. 1 by the action of spring 49 against spring cams 51 and 61. Returning to FIG. 5, the rotational direction urged upon chassis shafts 20 and 30 corresponds to arrows 80 and 81. Accordingly, wheel halves 22 and 32 are maintained in closure to form front wheel 12.

Figure 6:
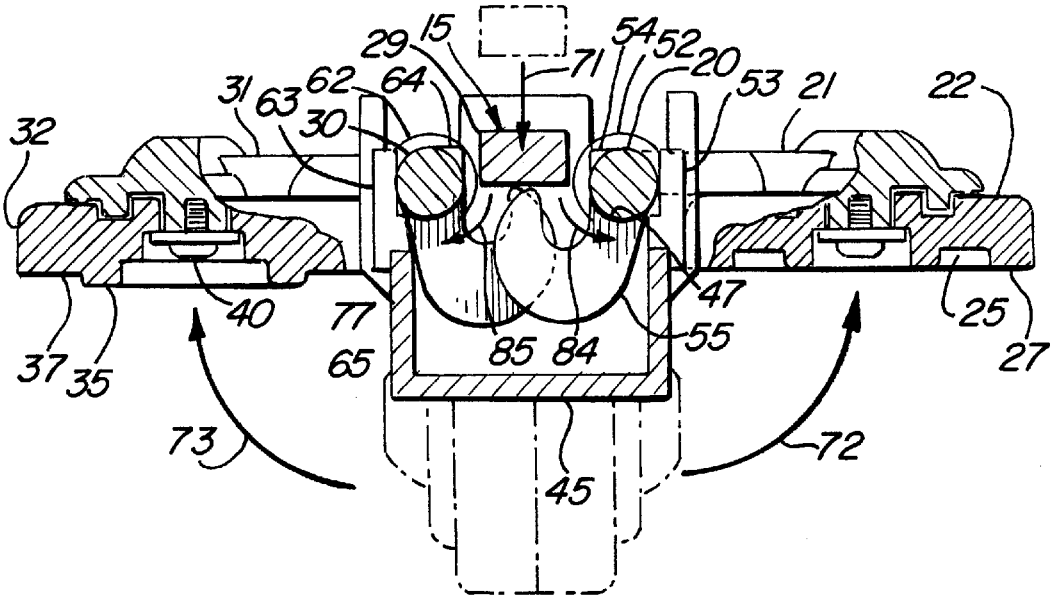
FIG. 6 sets forth a partial section view of the present invention toy motorcycle taken along section lines 5—5 in FIG. 3 showing the present invention toy motorcycle in its hovercycle configuration.

In accordance with the present invention, the user is able to reconfigure toy motorcycle 10 by forcing end 29 of lever 15 downwardly against lever cams 55 and 65 in the manner seen in FIG. 6. This downward force upon lever cams 55 and 65 produces a corresponding rotation of chassis shafts 20 and 30 in the directions indicated by arrows 82 and 83. Thus, as end 29 of lever 15 is forced downwardly upon lever cams 55 and 65, motorcycle 10 is reconfigured in the manner shown in FIG. 6.

FIG. 6 sets forth the section view of FIG. 5 following the above described movement of lever 15 causing reconfiguration of motorcycle 10 to its hovercycle configuration. Also shown in FIG. 6, are partial section views of wheel halves 22 and 32.

More specifically, motorcycle 10 includes a chassis box 45 supported within body 11 (seen in FIG. 1). Chassis box 45 defines a pair of journals 47 and 77 which rotatably support chassis shafts 20 and 30. Chassis box 45 further includes a pair of upwardly extending stops 53 and 63. Chassis shaft 20 includes a flange 52 and a lever cam 55. Chassis shaft 20 further supports a fork half 21 which in turn supports a wheel half 22 using a fastener axle 41. Wheel half 22 defines an annular groove 25 and an annular surface 27.

Chassis shaft 30 includes a flange 62 and a lever cam 65. Chassis shaft 30 further supports a fork half 31 which in turn rotatably supports a wheel half 32 using fastener axle 40. Wheel half 32 defines an annular rib 35 and an annular surface 37. Chassis shafts 20 and 30 further define stop tabs 54 and 64 respectively.

A lever 15 includes an end 29 and is pivotally supported within body 11 in the manner shown in FIG. 3. In operation, as the above described movement of lever 15 is implemented as the user forces end 16 of lever 15 upwardly in the direction indicated by arrow 17 in FIG. 3, a corresponding downward movement of end 29 in the direction indicated by arrow 71 occurs. This downward movement forces lever cams 55 and 65 to pivot downwardly as indicated by arrows 84 and 85. A corresponding pivotal movement of chassis shafts 20 and 30 results causing wheel halves 22 and 32 to pivot outwardly and upwardly in the directions indicated by arrows 72 and 73 respectively. At this point, motorcycle 10 has been reconfigured to the hover cycle shown in FIG. 2. It will be recalled that the cooperation of spring cams 51 and 61 together with spring 49 in the manner shown in FIG. 4 urges shafts 20 and 30 toward the closed configuration of FIG. 5. Thus, it will be understood that the outward pivotal movement of wheel halves 22 and 32 shown in FIG. 6 is accomplished to the opposition to spring 49 (seen in FIG. 4). Thus, when the user releases lever 15, the action of spring 49 and spring cams 51 and 61 (seen in FIG. 4) returns motorcycle 10 to closed configuration shown in FIG. 1.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy motorcycle configurable between a motorcycle configuration and a hovercycle configuration, said toy motorcycle comprising:

a body having a chassis box therein;

a pair of chassis shafts pivotally supported by said chassis box each shaft having a front end and a rear end;

a pair of front fork halves each supported by said front ends of said chassis shafts;

a pair of front wheel halves each supported by said front fork halves;

a pair of rear fork halves each supported by said rear ends of said chassis shafts;

a pair of rear wheel halves each supported by said rear fork halves; and means for pivoting said chassis shafts between a first position, in which said front and rear fork halves and said front and rear wheel halves are in contact defining said motorcycle configuration, and a second position in which said front and rear fork halves and said front and rear wheel halves extend outwardly defining said hovercycle configuration.

2. The toy motorcycle set forth in claim 1 wherein said means for pivoting includes:

a pair of lever cams supported on said chassis shafts; and a lever, pivotally supported on said body, having an end positioned against said lever cams, said lever being pivoted by said user to force said end against said lever cams to pivot said lever cams.

3. The toy motorcycle set forth in claim 2 further including spring means operative on said chassis shafts to urge said chassis shafts toward said first position.

4. The toy motorcycle set forth in claim 3 wherein said spring means include:

a pair of spring cams supported on said chassis shafts; and a spring having ends coupled to said spring cams.

5. The toy motorcycle set forth in claim 4 wherein one of said front wheel halves defines a first annular groove and the remaining one of said front wheel halves defines a first annular rib receivable in said first annular groove.

6. The toy motorcycle set forth in claim 5 wherein one of said rear wheel halves defines a second annular groove and the remaining one of said rear wheel halves defines a second annular rib receivable in said second annular groove.

7. The toy motorcycle set forth in claim 4 wherein one of said rear wheel halves defines an annular groove and the remaining one of said rear wheel halves defines an annular rib receivable in said annular groove.

8. A toy motorcycle comprising:

a body;

a pair of front fork halves and a pair of front wheel halves supported by said front fork halves;

a pair of rear fork halves and a pair of rear wheel halves supported by said rear fork halves; and means for supporting said front and rear fork halves upon said body movable between a motorcycle configuration, in which said front and rear wheel halves are together to from front and rear wheels, and a hovercycle configuration in which said front and rear wheel halves are separated and extended outwardly.

* * * * *